United States Patent [19]

Bridwell et al.

[11] 4,345,509

[45] Aug. 24, 1982

[54] CONTAMINANT TRAP FOR FLUID OPERATED ROTARY ACTUATOR

[75] Inventors: John W. Bridwell, Morton; James R. Doyle, Peoria, both of Ill.

[73] Assignee: Caterpillar Tractor Co., Peoria, Ill.

[21] Appl. No.: 245,233

[22] PCT Filed: Jun. 23, 1980

[86] PCT No.: PCT/US80/00782

§ 371 Date: Jun. 23, 1980

§ 102(e) Date: Jun. 23, 1980

[87] PCT Pub. No.: WO82/00045

PCT Pub. Date: Jan. 7, 1982

[51] Int. Cl.[3] ..... F15B 21/04; F01C 9/00

[52] U.S. Cl. ..... 92/78; 92/87; 92/121; 210/222

[58] Field of Search ..... 92/78, 79, 121, 87; 210/222

[56] References Cited

U.S. PATENT DOCUMENTS

| | | | |
|---|---|---|---|
| 2,854,956 | 10/1958 | Hager | 92/121 |
| 3,049,102 | 8/1962 | Reimer et al. | 92/121 |
| 3,696,713 | 10/1972 | Ragard | 92/121 |
| 3,731,598 | 5/1973 | Brignon | 92/121 |
| 3,869,391 | 3/1975 | Kramer | 210/222 |

FOREIGN PATENT DOCUMENTS

| | | | |
|---|---|---|---|
| 963281 | 7/1950 | France | 210/222 |
| 590173 | 7/1947 | United Kingdom | 210/222 |
| 861078 | 2/1961 | United Kingdom | 210/222 |

*Primary Examiner*—Ernest G. Therkorn
*Attorney, Agent, or Firm*—Phillips, Moore, Weissenberger, Lempio & Majestic

[57] ABSTRACT

A rotary actuator (11) having a vane (24) which is pivoted in a chamber (13) by fluid pressure to turn an actuator shaft (18) includes internal sump cavities (41A, 41B) that collect abrasive particles from the fluid and which hold such contaminants away from the path of movement of the vane (24). Shields (49A, 49B) protect the sumps (41A, 41B) from fluid turbulence. A magnetic element (47A, 47B) at each sump (41A, 41B) attracts and holds ferromagnetic particles and may be removed for cleaning without a general disassembly of the actuator (11) and with only a minimal draining of fluid. Actuator (11) durability is increased by reducing wear of moving components and maintenance is facilitated by simplifying cleaning. Among other uses, the invention may be employed in actuators (11) which swing a backhoe (34) relative to a supporting vehicle (32).

10 Claims, 3 Drawing Figures

CONTAMINANT TRAP FOR FLUID OPERATED ROTARY ACTUATOR

DESCRIPTION

1. Technical Field

This invention relates generally to rotary actuators for effecting limited controlled rotational movement of one element relative to another and more particularly to fluid pressure operated rotary actuators.

2. Background Art

Controlled changes of the rotational position of one component of a machine relative to another component are often provided for by connecting a fluid pressure operated rotary actuator between the components. For example, backhoe attachments for excavating earth and which are supported on a vehicle typically include a rotary hydraulic actuator which enables pivoting of the excavating elements relative to the vehicle about a vertical axis. Essentially similar rotary actuators are used in diverse other types of apparatus.

Rotary actuators of this type have a housing and an actuator shaft which jointly define an annular internal chamber. A divider fixed to the housing extends to the shaft within the chamber and a pivotal vane fixed to the shaft extends to the housing. By directing pressurized fluid into the chamber at one side of the divider while draining fluid at the other side, the vane and shaft may be caused to turn a desired amount relative to the housing. Seals are usually provided along the lines of contact of the vane and divider with the interior walls of the chamber and along the line of contact of the divider with the actuator shaft to avoid a loss of efficiency and precision from fluid leakage.

Durability has been reduced and maintenance problems have been complicated as a result of internal damage from abrasive metallic particles which accumulate in the actuator chamber. The harder and more abrasive particulate contaminants arise from the grinding of metal elements of the system and tend to be predominately ferromagnetic. Particles which accumulate at the bottom of the actuator chamber are repetitively moved back and forth by the motion of the actuator vane and damage the seals and walls of the actuator chamber. This ultimately requires replacement of actuator components and, in the interim, makes costly cleaning procedures advisable.

Damage from metallic contaminants tends to be relatively severe in rotary actuators as compared with other forms of fluid motors. The flushing effect of the fluid flow in a rotary actuator is often relatively low. In the backhoe usage discussed above, much larger volumes of fluid are typically applied to the piston and cylinder actuators which also manipulate portions of the mechanism. Further, it is a common practice to use a separate fluid source for the rotary actuator. Because of the low flow requirements, no filter may be provided in the flow circuit.

To minimize damage by particulate contaminants, it has been heretofore necessary to disassemble and clean the rotary actuator periodically. This includes draining and preferably replacing the actuator fluid. These maintenance procedures are undesirably complicated, costly and time consuming and at best do not avoid abrasion damage as effectively as would be desirable.

The present invention is directed to overcoming one or more of the problems as set forth above.

DISCLOSURE OF THE INVENTION

In one aspect of the present invention, a rotary actuator has housing means for defining a vane chamber, an actuator shaft extending within the vane chamber and being rotatable relative to the housing means, a vane extending radially from the actuator shaft within the vane chamber, and port means for transmitting pressurized fluid to and from the vane chamber to pivot the vane and turn the actuator shaft relative to the housing means. The actuator is further provided with trapping means for retaining particulate contaminants of the fluid in the chamber at a location which is away from the path of movement of the vane.

In another aspect of the present invention the actuator includes magnetic means for holding ferromagnetic particles at the location away from the path of movement of the vane.

In still another aspect of the present invention, the trapping means includes a sump cavity formed in one of the vane chamber walls outside the area of the wall which is swept by the vane during pivotal movement of the vane, and closure means for enabling removal of particulate contaminants from the housing means while the vane is positioned to retain a large proportion of the fluid in the vane chamber.

In still another aspect of the present invention, shield means are provided for shielding the sump cavity from fluid turbulence created by vane movement.

The invention prolongs the effective life of rotary actuators by reducing damage to seals, chamber walls and other components by abrasive particles which may be present in the actuator fluid. Particulate contaminants are collected and retained at a location within the housing which is away from the areas of contact between relatively moving components. Maintenance procedures are also simplified as accumulated particulate contaminants may easily be removed at intervals without a general disassembly of the actuator and without necessarily draining a sizable amount of fluid from the device.

BEST MODE FOR CARRYING OUT THE INVENTION

Figure 1:
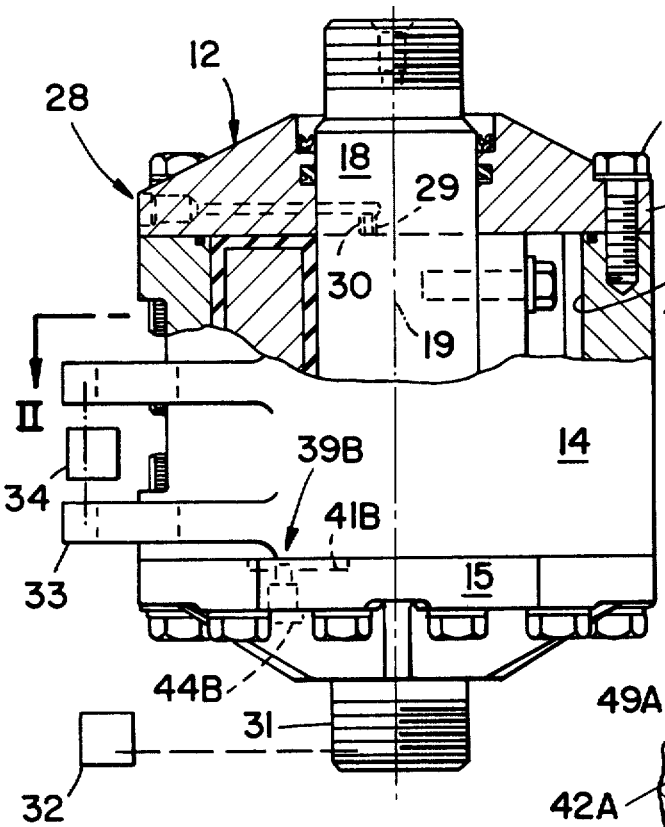
FIG. 1 is an elevation view of a rotary actuator which includes an embodiment of the present invention, portions of the structure being broken out to illustrate internal elements of the device.
Figure 2:
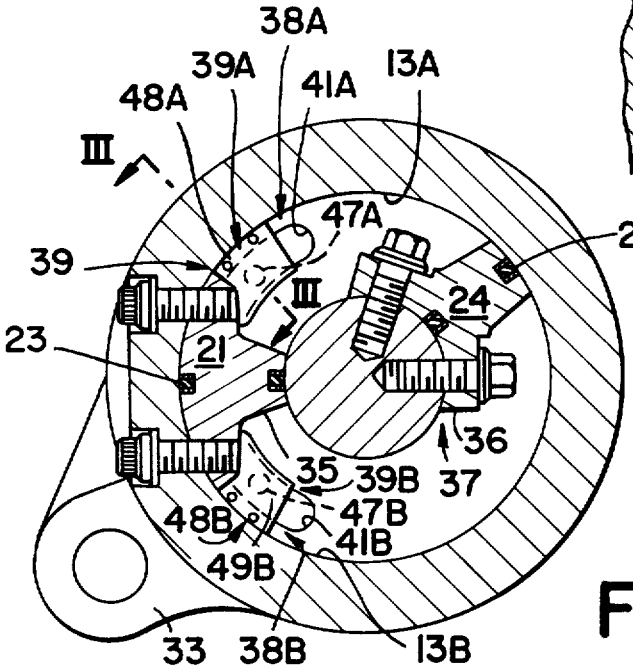
FIG. 2 is a cross section view of the actuator of FIG. 1 taken along line II—II thereof.

Referring to FIGS. 1 and 2 of the drawings in conjunction, a rotary actuator 11 of the type to which the invention is applicable typically includes housing means 12 for defining an internal vane chamber 13. In this example, the housing means 12 includes a cylindrical barrel member 14 and coaxially positioned first and second annular end plates 15 and 16 respectively, such elements being secured together by suitable means such as bolts 17. A relatively rotatable actuator shaft 18 is disposed along the rotational axis 19 of the actuator 11 and extends from each end of the housing 12 through the end plates 15 and 16. The vane chamber 13, defined by housing 12 and actuator shaft 18 thus has an annular configuration.

Vane chamber 13 is divided into variable subchambers 13A and 13B in part by a divider member 21 secured to barrel member 14 and which extends radially inward to contact actuator shaft 18. To prevent fluid leakage, a closed loop seal 23 extends along the lines of contact of the divider 21 with actuator shaft 18, barrel member 14 and first and second end plates 15 and 16.

The division of vane chamber 13 into variable subchambers 13A and 13B is completed by a vane 24 secured to actuator shaft 18 and which extends from the shaft in a radial direction to contact the inner surface of barrel member 14. Another closed loop seal 27 carried by vane 24 extends along the lines of contact of the vane with barrel member 14, actuator shaft 18 and first and second end plates 15 and 16. Accordingly vane 24 may be made to undergo pivotal motion to rotate actuator shaft 18 relative to the housing 12 by admitting pressurized fluid into one of the subchambers 13A, 13B while allowing fluid to be released from the other of the subchambers. Port means 28 for this purpose includes first and second flow passages 29 and 30 respectively in the second end plate 16. Passages 29 and 30, which may be connected with a pressurized fluid source through a control valve in the known manner, communicate with the vane chamber 13 at opposite sides of divider 21.

One or both ends of actuator shaft 18 may be provided with threads 31 or other appropriate means for coupling the shaft to a first machine component 32 while housing 12 has means, apertured tabs 33 in this example, for coupling the actuator to another machine component 34, components 32 and 34 being structures which are to undergo limited controlled rotary movement relative to each other. In the backhoe usage discussed above for purposes of example, the first component 32 to which actuator shaft 18 is coupled is typically the movable linkage which supports the excavating elements and which is oscillated about a vertical rotational axis 19 by operation of the actuator 11. The second component 34 is the frame of the vehicle. In other instances, shaft 18 may be coupled to fixed structure with housing 12 being the movable member.

Referring to FIG. 2 in particular, in instances where vane motion is not limited by the external mechanism to which the actuator is coupled, internal means 37 for this purpose can be provided. For example it may be noted that opposite shoulders 35 of divider 21 in conjunction with opposite shoulders 36 of vane 24 may constitute stop means 37 for limiting the pivoting movement of the vane to a predetermined sector of the vane chamber 13. Thus at the extreme limits of movement, the vane 24 does not move through an end region 38A of subchamber 13A nor a corresponding end region 38B of subchamber 13B. Contaminant trapping means 39, including first 39A and second 39B traps are disposed at the chamber end regions 38A and 38B respectively for holding particulate contaminants of the fluid in chamber 13 at locations which are away from the path of movement of the vane 24.

Figure 3:
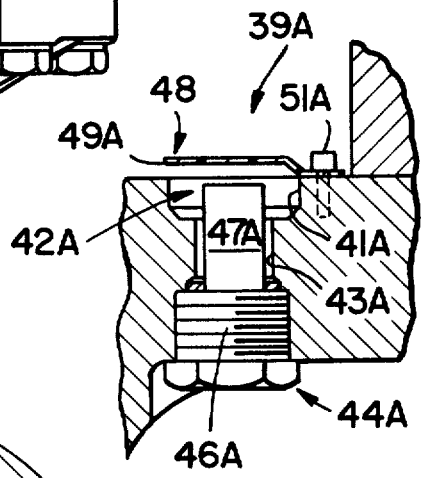
FIG. 3 is a partial section view of a portion of the actuator taken along line III—III of FIG. 2 further illustrating suitable structure for the contaminant trapping means.

Referring now to FIGS. 2 and 3 in conjunction, the first trapping means 39A includes a sump cavity 41A formed in first end plate 15 at a location, in end region 38A, which is outside the part of subchamber 13A through which the vane 24 moves. Sump cavity 41A is situated in the first end plate 15 in the present example since the actuator 11 in this particular case is designed to be used with the rotational axis 19 extending vertically and with first end plate 15 being the lower most of the two end plates 15 and 16. It is advantageous if the sump cavity 41A is at the bottom of the vane chamber 13 and thus in instances where the actuator 11 is to be differently oriented in use, the sump cavity 41A may variously be formed in the opposite end plate 16 or in the inner wall of barrel member 14 if the rotational axis 19 is horizontal.

Owing in part to the action of gravity, particulate contaminants in the actuator fluid collect in the sump cavity 41A. The collection and retention of particles, which tend to be predominantly ferromagnetic, is also aided by magnetic means 42A situated in the sump cavity 41A. In this example, an access passage 43A in end plate 15 extends from the sump cavity 41A to the exterior of the housing 12 and is normally closed by a disengagable closure means 44A which in this instance is a plug 46A threadably engaged in the access passage. The magnetic means 42A in this case is a cylindrical permanent magnet 47A secured to plug 46A and which extends up into sump cavity 41A when the closure means 44A is engaged in passage 43A.

Retention of particles which accumulate in the sump cavity 41A is further aided by shield means 48A for shielding the sump cavity from fluid turbulence created by movement of vane 24. A shield member 49A, preferably formed of nonmagnetic material such as brass, aluminum or a suitable plastic, is disposed over a portion of the sump cavity 41A which is furthest from vane 24 and which contains the magnet 47A, the shield member being spaced a small distance above the surface of end plate 15. Shield member 49A has a downwardly angled edge in contact with end plate 15, adjacent the inner surface of the barrel member 14, which enables the shield member to be secured to first end plate 15 by screws 51A.

The second trapping means 39B may be of essentially similar construction except insofar as it is located in the end region 38B of subchamber 13B which is beyond the path of movement of vane 24 at the opposite limit of vane travel. Thus trapping means 39B may include a second sump cavity 41B partially covered by shield means 48B including a shield member 49B, a magnet 47B within the shielded region of the sump cavity, and closure means 44B each similar to the corresponding portions of first trapping means 39A.

Industrial Applicability

The described example of the invention was designed for use as a means for pivoting the movable components of a backhoe attachment, relative to a supporting vehicle, about a vertical axis. In that context, actuator shaft 18 may be coupled to the movable backhoe components 32 while housing means 12 is coupled to a frame element 34 through tabs 33. By admitting hydraulic fluid, such as oil, to one of the port passages 29 and 31 while venting the other passage back to tank, shaft 18 is caused to turn about the vertical axis 19 as a result of the pressure differential at opposite sides of the vane 24. The elements 32 and 34 may then be held at a selected angular orientation relative to each other by blocking fluid flow to and from the port means 28 as fluid cannot then escape from either of the subchambers 13A and 13B as would be required to enable such movement.

It should be understood that the invention has been described as employed in the context of a backhoe attachment for purposes of example only, there being many other forms of apparatus known to the art which utilize essentially similar rotary actuators 11.

During usage of the actuator 11 over a period of time, particulate contaminants which are present in the vane chamber 13 and which may be more or less continually carried into the vane chamber by incoming hydraulic fluid tend to collect in the sump cavities 41A and 41B in part as a result of gravitational action. Collection of the particles into the sump cavities 41A, 41B and retention of the particles, which are predominantly ferromagnetic in most systems, is assisted by the magnets 47A and 47B. Retention of the accumulated particles is also aided by the shield members 49A and 49B which reduce fluid turbulence in the regions of the sump cavities 41A, 41B around the magnets 47A, 47B.

To the extent that the trapping means 39 collects particulate contaminants and holds such material away from the zones of contact between relatively moving components, such as the moving zones of contact between barrel member 14, end plates 15 and 16 and vane seal 27 and the zone of contact between divider seal 23 and actuator shaft 18, abrasive wearing of such components is reduced and durability of the actuator 11 is increased.

In addition to directly reducing the adverse effects of particulate contaminants in the actuator 11, the invention also greatly simplifies and facilitates periodic cleaning as a general disassembly of the mechanism is not needed for this purpose. Periodically, accumulated particulate contaminants may be easily removed by simply unthreading plugs 46 at a time when the port means 28 are unpressurized. Removal of the plug 46 from access passage 43 also removes accumulated ferromagnetic particles which cling to the magnet 47A portion of the closure means 44. The draining of some of the fluid through access passage 43 which follows removal of plug 46 also assists cleaning by washing out nonmagnetic particles which may not be clinging to the magnet 47A. In this connection, cleaning does not necessarily require draining of the entire fluid contents of the vane chamber 13. Prior to removal of one of the plugs 46A, the actuator 11 may be operated to pivot the vane 24 around to its closest point of travel to the particular sump cavity 41A which is being cleaned. Under this condition, a large proportion of the total fluid contents of the vane chamber 13 remains trapped behind the vane 24 and only a relatively small portion is drained upon opening of the closure means 44. Upon reinstallation of the closure means 44A, the actuator 11 may be operated to rotate the vane 24 to the opposite extreme of vane movement after which the other closure means 44B may be temporarily removed to clean the second sump cavity 41B, in a similar manner, with minimized draining of fluid from the actuator.

Other aspects, objects and advantages of this invention can be obtained from a study of the drawings, the disclosure and the appended claims.

We claim:

1. In a rotary actuator (11) having housing means (12) for defining a vane chamber (13), an actuator shaft (18) extending within the vane chamber (13) and being rotatable relative to the housing means (12), a vane (24) extending radially from the actuator shaft (18) within the vane chamber (13), and port means (28) for transmitting pressurized fluid to and from the vane chamber (13) through flow passages (29, 30) which open into said vane chamber (13) to pivot the vane (24) and turn the actuator shaft (18) relative to the housing means (12), the improvement comprising:

trapping means (39) for retaining particulate contaminants of the fluid within the vane chamber (13) at a location (38A) which is away from the path of movement of the vane (24) and away from said flow passages (29, 30), wherein said trapping means (39) includes at least a pair of spaced apart sump cavities (41A, 41B) formed within said housing means (12) and opening into said vane chamber (13), a first (41A) of said sump cavities (41A, 41B) being adjacent one end of the path of travel of said vane (24) and the other (41B) of said sump cavities being adjacent the other end of the path of travel of said vane (24).

2. A rotary actuator as set forth in claim 1 wherein said trapping means (39) includes magnetic means (42A) for magnetically retaining ferromagnetic particles at said location (38A).

3. A rotary actuator as set forth in claim 1 wherein said trapping means (39) includes shield means (48A) for shielding said location (38A) from fluid turbulence caused by movement of said vane (24).

4. A rotary actuator as set forth in claim 1 wherein said trapping means (39) includes removable closure means (44A) for enabling removal of said particulate contaminants from said location (38A).

5. A rotary actuator as set forth in claim 4 wherein at least a portion (47A) of said removable closure means (44) is a magnet.

6. A rotary actuator as set forth in claim 1 wherein said housing means (12) includes spaced apart members (15, 16) forming opposite walls of said vane chamber (13) between which said actuator shaft (18) extends and said trapping means (39) includes a sump cavity (41A) formed in one of said members (15) and which communicates with said vane chamber (13) at said location (38A) which is away from said path of movement of said vane (24).

7. A rotary actuator as set forth in claim 6 wherein said vane chamber (13) includes variable volume subchambers (13A, 13B) situated at opposite sides of said vane (24), further including closure means (44) for enabling removal of said particulate contaminants from said housing means (12) while said vane (24) retains fluid in one of said subchambers (13B).

8. A rotary actuator as set forth in claim 7 further including a shield member (49A) positioned between said sump cavity (41A) and the path of movement of said vane (24).

9. A rotary actuator (11) comprising:

a housing (12) having a cylindrical internal chamber (13) and an access passage (43A) communicating therewith and spaced apart flat parallel end walls (15, 16) at each end of said chamber (13);

an actuator shaft (18) extending into said cylindrical chamber (13) along the axis (19) thereof and being rotatable relative to said housing (12);

a vane (24) disposed in said chamber (13) and extending radially relative to said axis (19) thereof and being pivotable about said axis (19) within a predetermined sector of said chamber (13), said vane (24) being coupled to said actuator shaft (18);

port means (28) for admitting pressurized fluid into said chamber (13) through flow passages (29, 30) which communicate therewith to cause said pivoting movement of said vane (24);

a magnetic element (47A) located within said housing (12) at a location (38A) outside of said predetermined sector of said chamber (13) and outside of said flow passages (29, 30);

closure means (44) for closing said access passage (43), said closure means (44) being disengagable to enable removal of said magnetic element (47A) from said housing (12) through said access passage (43A);

one (15) of said endwalls having a sump cavity (41A) therein at a location (38A) outside of said predetermined sector of said chamber (13), at least a portion of said magnetic element (47A) being located in said sump cavity (41A); and wherein said access passage (43A) communicates with said sump cavity (41A).

10. A rotary actuator (11) as set forth in claim 9 further comprising a nonmagnetic shield (49A) positioned between said magnetic element (47A) and said predetermined sector of said chamber (13).

* * * * *